United States Patent [19]

Martin

[11] 4,233,698

[45] Nov. 18, 1980

[54] PRESSURE FLUSH TANK FOR TOILETS

[75] Inventor: Raymond B. Martin, Birmingham, Mich.

[73] Assignee: Water Control Products/N.A., Inc., Troy, Mich.

[21] Appl. No.: 763,502

[22] Filed: Jan. 28, 1977

[51] Int. Cl.[3] ..... E03D 3/04

[52] U.S. Cl. ..... 4/354; 4/356; 137/206; 251/144

[58] Field of Search ..... 4/20, 26, 27, 28, 29, 4/30, 31, 34, 37, 41, 52, 55, 63, 65; 137/572, 630, 630.14, 215, 216; 251/55, 144

[56] References Cited

U.S. PATENT DOCUMENTS

| | | | |
|---|---|---|---|
| 1,231,828 | 7/1917 | West et al. | 4/29 |
| 2,891,578 | 6/1959 | Dahl et al. | 138/45 |
| 3,555,571 | 1/1971 | Gibbs et al. | 4/31 |
| 3,605,125 | 9/1971 | Gibbs et al. | 4/26 |
| 3,677,294 | 7/1972 | Gibbs et al. | 4/26 |
| 3,817,279 | 6/1974 | Larson | 4/26 |
| 3,817,489 | 6/1974 | Caron et al. | 4/29 |
| 3,820,171 | 6/1974 | Larson | 4/31 |
| 3,820,754 | 6/1974 | Caron et al. | 4/29 |

*Primary Examiner*—Richard R. Stearns

*Attorney, Agent, or Firm*—Barnes, Kisselle, Raisch & Choate

[57] ABSTRACT

A pressure flush tank assembly for toilets which includes a combination of a flush valve coordinated with an air induction valve and refill valve to insure successful repetitive operation, together with a construction which prevents back-flow in the event of a negative line pressure and an initial outflow control to reduce noise and eliminate back bounce from the toilet bowl.

9 Claims, 7 Drawing Figures

Figure 2:
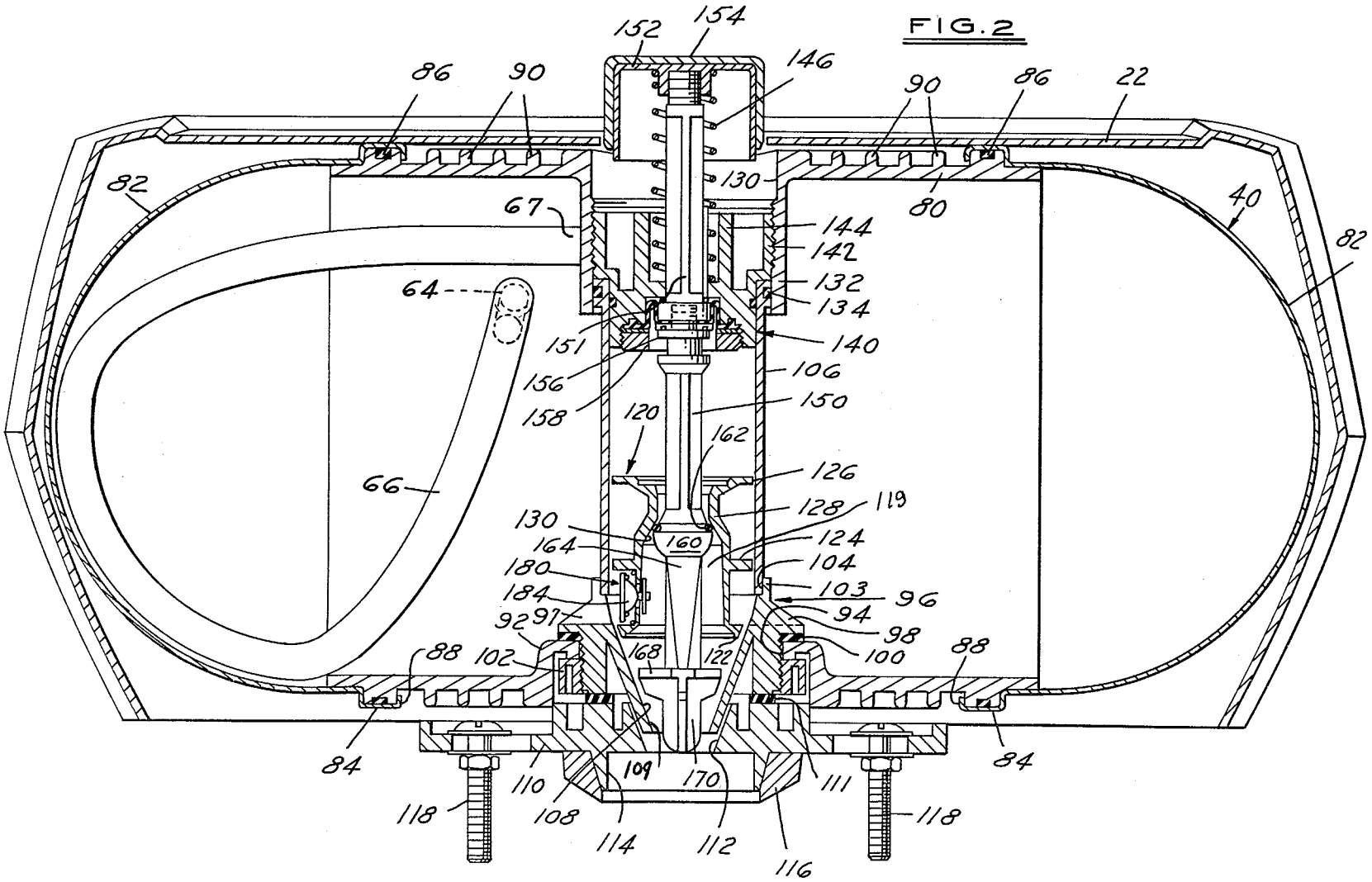

FIG. 1
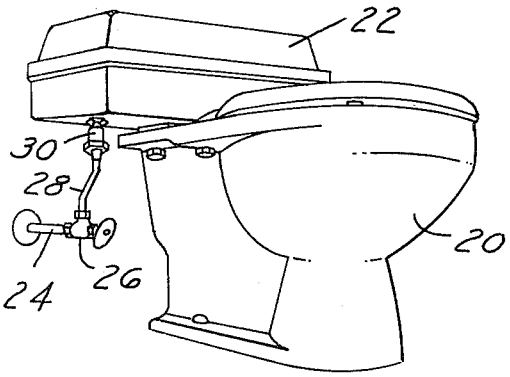
FIG. 4
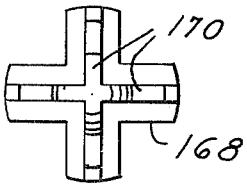
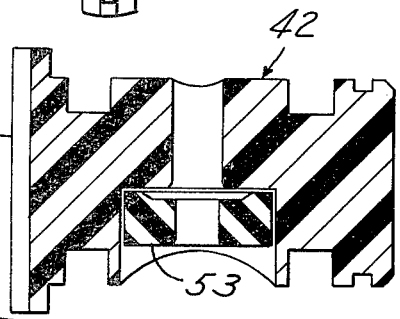
FIG. 7
FIG. 3
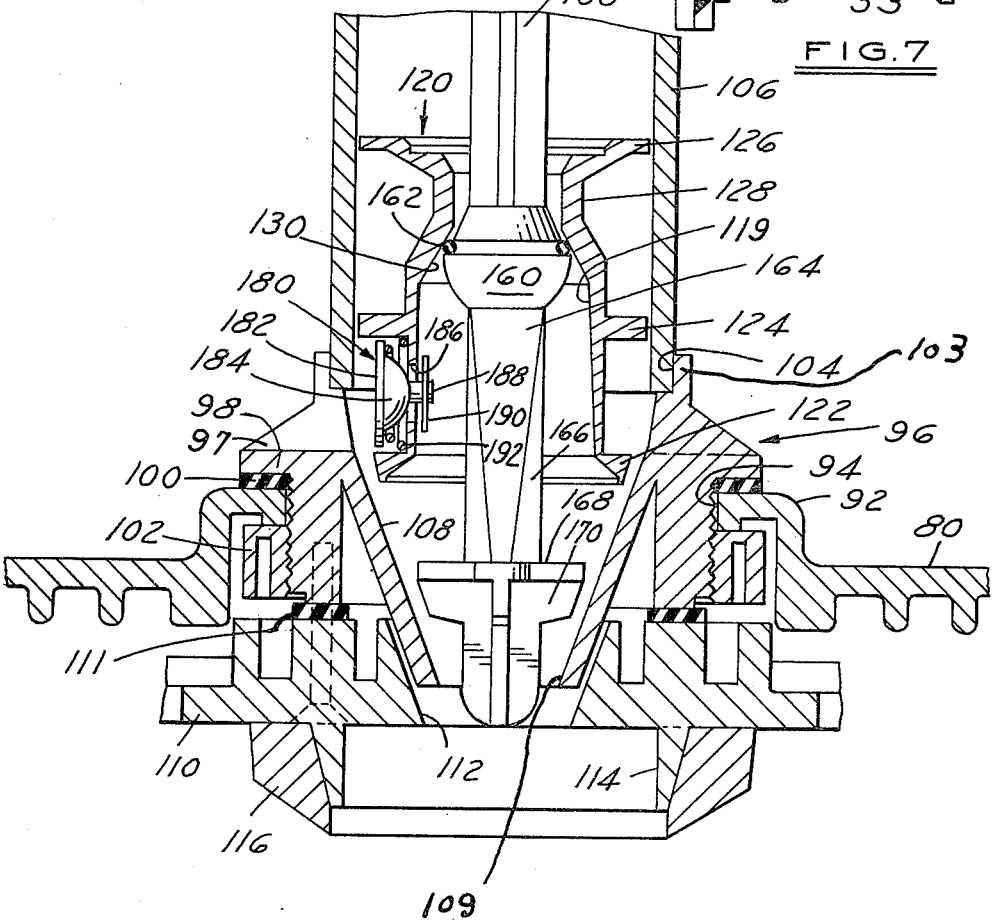

PRESSURE FLUSH TANK FOR TOILETS

This invention relates to a Pressure Flush Tank for Toilets and more particularly to an improved assembly of a flush valve, refill valve, and air induction valve to insure safe and reliable operation at all times.

The general state of the art is to be found in the following patents:

U.S. Pat. No. 3,605,125, Sept. 20, 1971, Gibbs et al;

U.S. Pat. No. 3,817,489 June 18, 1974 Caron et al;

U.S. Pat. No. 3,820,754 June 28, 1974 Caron et al.

To insure reliable operation of a pressure flush toilet, it is necessary to have a volume of compressed air above the water charge in the pressure tank. Because of air absorption in water and also humidification of the air, the effectiveness of a single air charge is dissipated in repeated operations; it is important, therefore, that means be provided to effect replenishment. A further essential for successful operation is adequate refill water discharged into the toilet following the flush. Many attempts at delayed valve closing have been made to solve this problem, but uniform non-wasteful operation has been difficult to attain. Another problem incident to this type of flushing unit is safety when repair or replacement of parts is to be instituted.

It is an object of the present invention to provide an improved assembly of valves in a pressure flush system in which adequate replenishment air is assured with an adequate bowl refill which cooperates, in each case, with, and is dependent on, the recharging water inflow.

A further object is the provision of a simplified assembly which incorporates the refill valve in the main valve control unit and which inherently permits safe and easy repair and replacement.

Another object of the invention relates to the prevention of backflow in the event a negative pressure condition develops in a system. This can happen in a low pressure system when there is a large use in a home downstairs with a toilet upstairs. It can also occur in an area where an abnormal demand on a community water system due to fire hose use lowers the water pressure excessively.

An anti-backflow system which prevents entry of contaminated water into a water supply in the event a negative pressure condition develops is, therefore, a significant feature of the present invention.

It is an object to provide a flushing apparatus which is inherently responsive to pressure in the supply and which responds to lack of such pressure in a manner to safeguard the water system in which the device is installed.

It is a further object to provide a series of backflow protective devices to insure adequate protection.

A further feature of the invention is a device incorporated into the valving arrangement which regulates initial flow out of the pressurized tank to prevent bounce back from the bowl and to reduce the noise of the flushing operation.

Other objects and features of the invention will be apparent in the following description and claims in which the principles of construction and operation are set forth together with a detailing of the best mode presently contemplated and directed to persons skilled in the art to enable them to practice the invention.

Drawings accompany the disclosure and the various views thereof may be briefly described as:

FIG. 1, a view of the general assembly of the combination as applied to a modern toilet.

FIG. 2, a sectional view through the pressure tank showing the operative valves in section.

FIG. 3, a sectional enlarged view of the main operating valve and the after fill valve.

FIG. 4, an end view of a shock prevention valve.

Figure 5:
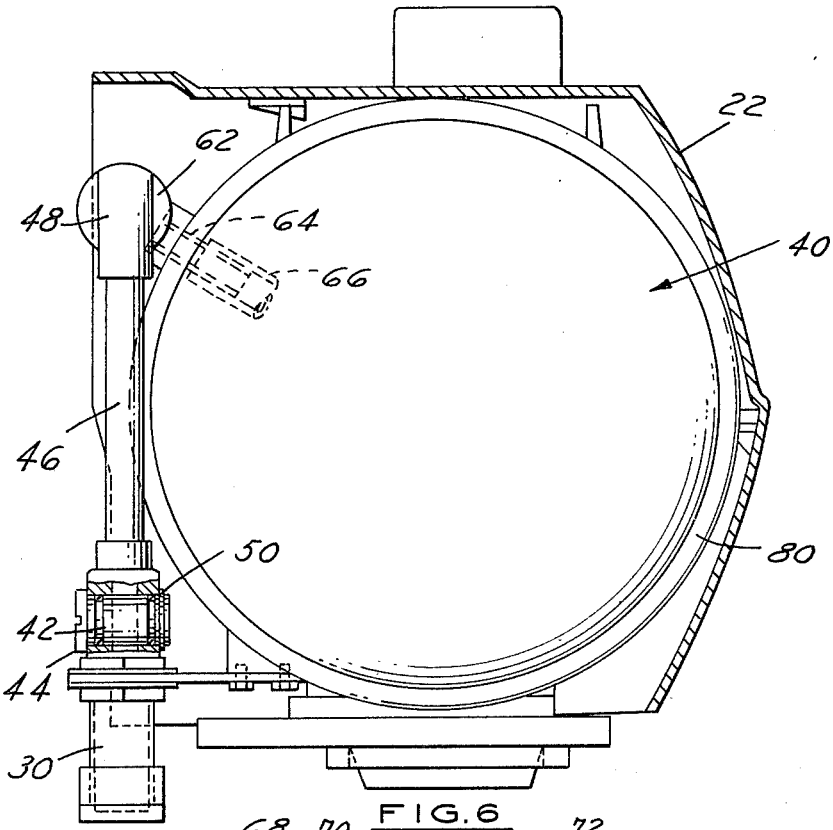

FIG. 5, a transverse sectional view showing a water inlet and supply tube.

Figure 6:
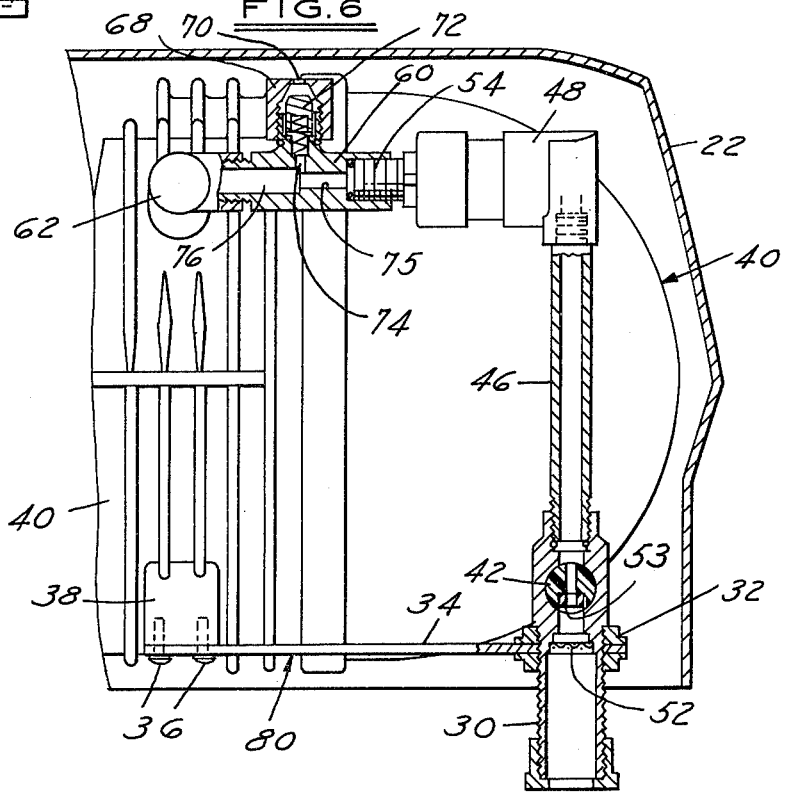

FIG. 6, a view partially in section showing the water inlet and air induction portion of the system.

FIG. 7, an enlarged view of the flow control valve.

WATER AND AIR SUPPLY

Referring to the drawings:

In FIG. 1, a standard toilet bowl 20 is shown and mounted on the back of this bowl is an elongate tank enclosure housing 22 above a water supply pipe 24, a shut-off valve 26 and a supply pipe 28 leading to a shank 30 of a pipe inlet fixture for the tank 22. As viewed in FIG. 6, the shank 30 is secured in a collar 32 mounted in a bracket plate 34 fastened by screws 36 to a lug 38 formed on a pressure tank 40 enclosed within the housing 22. A gate valve 42 is provided in shank 30 operated by a screw head 44 (FIG. 5) automatically to control inlet flow. A nipple pipe 46 connects to an elbow housing 48 in which is located an anti-siphon device consisting of two independent, spring loaded back check valves with an intermediate air induction zone (details not shown).

The flow control valve 42 is sealed at either end by suitably positioned O-rings and is held in place by a snap ring 50. A filter screen 52 is located in shank 30. An automatic flow control valve, including a flexible member 53 (FIG. 7) is incorporated into the feed supply line valve 42 which is the type responsive to line pressure. This type of valve 53 has a flexible member subject to line pressure and having a restrictive aperture. The aperture in member 53 is contracted by line pressure, thus holding the flow rate through the valve at a set rate. Further adjustment to lower the flow rate is possible by rotation of the valve 42. The greater the line pressure, the smaller the aperture.

The backflow prevention housing 48 terminates in a male extension 54 (FIG. 6) which inserts into a female recess in one end of an air inducer housing 60 which in turn terminates at the other end in a supply tube adapter 62 with a tubular fitting 64 for a tube 66 which lies within the pressure tank 40. The tube 66 is flexible and the outlet end 67 is supported mechanically behind the cylindrical extension 132 so that it is more than 1 inch or more above the highest point that water can rise in the tank 40. This provides an initial protection against backflow which might otherwise occur if a negative pressure developed in the supply line. A cap 68 threaded onto housing 60 has an air inlet opening port 70 below which is a spring pressed air inlet valve 72. A short passage 74 below valve 72 intercepts a stepped, longitudinal passage 75, 76 in housing 60 leading to the supply tube adapter 48. Passage 74 intercepts the passage 75, 76 at the juncture of the smaller passage with the larger passage, this creating a venturi induction effect when water is flowing.

A rapid flow of water in passage 76 will, by induction, cause valve 72 to open and admit air through port 70 around the valve where it will be entrapped by incoming water and move into the interior of tank 40 to insure an adequate supply of air as will be explained later in connection with the operation.

FLUSH VALVE

Turning now to the elongate sectional view of the device in FIG. 2, there is shown the outer housing 22, intended to be decorative in nature, surrounding the pressure tank 40 which is composed of a central cast cylindrical, ribbed housing 80 closed at each end by a domed hemispherical cap 82 sealed at a flanged edge 84 by a ring seal 86. A flange 88 can be spun around an annular end rib on the central container 80 to secure the tank end caps 82 in sealed relation on the center section. The annular ribs or flanges 90 add structural strength to the center section.

At the bottom of the center section 80 (see FIG. 3 for enlarged view) is a circular hole 94 surrounded by an upstanding flange 92 to receive a threaded discharge adapter 96 having a top flange 98 overlying flange 92. A sealing ring 100 is interposed between these flanges. A threaded lock ring 102 is positioned against the bottom of flange 92 to hold the adapter securely in position. The adapter 96 has upstanding, circumferentially spaced lugs 103 each having an undercut recess 104 to receive the bottom end of a cylinder sleeve 106, and the bottom end of the adapter has an inwardly tapered wall 108 to serve as a flush outlet 109 and valve seat. The tank is open to the interior of the adapter 96 through the radial passages 97 between the spaced lugs 103.

Below the opening 94 and the discharge adapter 96 is a bolt plate 110 underlying the center section of the tank and suitably secured to the tank by self-tapping screws. A ring seal 111 is interposed to seal the adapter to the bolt plate. The plate 110 has an opening 112 to receive the lower end of the tapered section 108 of the discharge adapter and a larger lower opening 114 to interfit with an opening on the toilet bowl and be sealed thereto by a gasket 116. Bolts 118 serve to secure the bolt plate to the toilet.

Slidably mounted within the sleeve 106 is a flush valve 120 consisting of a substantially cylindrical shell having three radial flanges 122, 124, and 126 at the bottom, mid-portion and top, respectively, with a narrowed or necked-down portion 128 between the mid-flange and the top flange which forms internally a tapered seat 130 at the lower portion of the restricted portion 128. The flanges 124 and 126 have a diameter of a few thousandths of an inch less than the internal diameter of sleeve 106, which can be about 2 inches, to insure a non-bonding movement within the sleeve and to permit water and air to flow around the valve to the control chamber above it in sleeve 106 as will be described in connection with the operation. The diametrical clearance can range from 0.035" to 0.0175" but may be varied to achieve different results. The clearance provided will depend on the quantity of water to be discharged. For example, the washing of a urinal requires less water than flushing of a toilet. The by-pass flow around the valve 120 might also be provided by one or more calibrated openings in the tube 106.

CONTROL VALVE

Looking now at the top portion of FIG. 2, we find a central opening 130, concentric and co-axial with bottom opening 94 in the central tank section 80, below which is a cylindrical extension 132 threaded internally, and into which projects the top end of sleeve 106 sealed to a smooth portion of the extension by an O-ring 134.

A control valve support ring 140 has a threaded wall 142 threaded into and supported by extension 132 with a concentric inner collar 144 serving as a spring seat for a functioning compression spring 146. A lower portion of the ring 140 telescopes into the interior of sleeve 106, sealed suitably by an O-ring, and supports a fluted control valve stem 150 which slides in an opening at the bottom of the spring well collar 144. A top actuator extension 151 threaded on to valve stem 150 is surrounded by the spring 146 and carries a push cap 152 threaded on the top of the stem and covered by a decorative cap 154. The inner periphery of a roll-type flexible diaphragm seal is captured between the bottom of extension 151 and a small ring flange 156 on the top of stem 150. The outer periphery is held between a bottom surface on ring 140 and a lock-nut 158. An annular ridge on the outer periphery interfits into an annular groove in the ring 140.

Below valve stem 150 is a bulbiferous valve formation 160 carrying an O-ring 162 intended to cooperate with the tapered valve seat 130. Below the formation 160 is a shaft 164 with enlarging flutes 166 (FIG. 3) terminating at a cuniform plate 168 which has a fluted cuniform extension in the form of thin bracket-like fins 170 rounded off at the bottom. This plate 168 has a function in controlling the discharge flow rate as will be described later. This can very from 10 to 15 gallons per minute to 25 to 40 gallons per minute depending on the requirements.

REFILL VALVE

In FIGS. 2 and 3, there is illustrated a refill valve 180 mounted in the wall of cylinder 128 between the mid-flange 124 and the bottom flange 122. As shown best in FIG. 3, this valve comprises a small circular valve plate 182 having formed thereon a spherical protuberance 184 preferably made of a synthetic having some resilience to seat and seal against the edges of a hole 186 in the wall of cylinder 128. A small projection 188 carries a retainer disc 190. A light compression spring 192 is interposed between the wall and the plate 182 to hold the valve in a normally open position only to be closed by internal tank pressure as will be described. While this refill valve is shown located in a wall of cylinder valve 128, it may be located at any point where it is exposed to pressure in the tank on one side and drain access to the bowl on the other side. It is thus closed as the tank pressure reaches a predetermined setting during a refill cycle. Thus, this valve exemplifies the important principle of a secondary refill valve subject to and closed by the increasing pressure in the flush tank.

THE OPERATION OF THE SYSTEM

The operation will be described starting first with the assumption that the tank 82 is filled with water to a point below the entrance of the tube 66 and that there is a volume of air compressed above the surface of the water. Under these circumstances, the pressure in the sleeve 106 above the valve 120 will be holding the valve down against the action of the spring 146 so that the flange 122 is sealed against the tapered valve seat 108. At the same time, the O-ring 162 on the formation 160 is sealed against the valved seat 130. Also, the pressure in the tank is acting on the plate 182 to close the valve 184 against the hole 186.

It will be appreciated that the rolling diaphragm seal 151 seals the top of the chamber in the sleeve 106. Under these circumstances, when the manual cap 154 is pushed downwardly against the spring 146, the valve seat 130 in the valve 120 will be opened so that fluid (air and water) which has reached the chamber above the valve 120 by reason of the clearance around the flanges 124 and 126 will be discharged freely through the central portion 119 of the valve 120 and around the stem 164 where it will move down to flow around the cuniform plate 168 into the discharge adapter opening and thence through the opening 114 into the vessel to be flushed. Water under pressure from the main tank entering the sleeve 106 and the adapter 96 through opening between the lugs 103 (opening 97) and then acting on the lower portion of the flush valve 120 will lift the flush valve away from the seat 108 to expose the discharge hole of the tank to the outlet opening 109 at the bottom of the seat 108.

With the flush valve open, the compression in the trapped air at the top of tank 40 pushes water from the main tank into the sleeve 106 and adapter 96 assembly and out the tank discharge 109. Due to the relative size of the openings, water enters the sleeve 106 faster than it can escape through the opening 109. Excess water pushes up around the flush valve into the chamber above the valve 120 and exits down the center hole of the flush valve 120. Flow of water up around the flush valve also begins to push the valve back down, thus expanding the upper chamber in sleeve 106. As valve 120 drops, the center escape hole 119 is being closed by the valve enlargement 160. Water pressure continues to push the flush valve 120 back into its seat, thus expanding the upper chamber in sleeve 106 to its maximum capacity at which point the pressure in this area begins to increase, thus creating a pressure seal. By this time, the tank is almost completely discharged and the siphonic action of the toilet is operational.

Any pressure drop in the tank 40 will cause water to flow into it from the water supply valve 46. Thus, as soon as the flush valve 120 is opened and the pressure in the main tank begins to be reduced, flow into the tank from the supply line begins. As the pressure continues to drop, flow into the tank steadily increases so that at the point when the flush valve 120 closes, tank pressure has been reduced to almost that of the atmosphere, and flow into the tank from the supply line 46 is at its peak rate.

The plate 168 with its depending fins 170 will momentarily restrict the flow of pressurized water from the tank 40. The release of pressure above the valve 120 will permit the pressurized water in the tank to lift the valve into the sleeve 106. The disc 168 has the corner flow holes of specific area and the location of the disc on the lower stem 164 is such that when the button 154 is depressed, the disc closes off the discharge adapter hole except for the corner openings. Even though the manually actuated cap 154 is released, the entire control valve construction, including the disc 168, will be held down for a period that varies directly with the static pressure in the tank, the higher the pressure in the tank, the larger the interval of holddown. However, the total area of the corner holes in the plate 168 is greater than the inlet to the tank so that the pressure in the tank pushes water out of the tank at a low rate. Nevertheless, since more water is leaving the tank than entering the tank, the tank pressure decreases until the force of the return spring 146 is greater than the force on the plate. At this point, the return spring moves the stem assembly up, opening the full discharge adapter hole and the outflow increases substantially as the main body of water in the tank is discharged. The effect of this initial water flow control results in a significant reduction in discharge noise and elimination of recoil against the push button and the prevention of any bounce back that might be created by a sudden rush of pressurized water into the toilet vessel.

As the main tank is discharged, the pressure in the tank is lowered and water begins to flow through the shank 30 and pipe 46 through the control valve 48 and backflow inhibitor 48. The vacuum created at the air induction valve 72 by this flow through the passage 75, 76 pulls open the spring pressed poppet valve 72 allowing air to enter the tank through the opening 70 to replace air lost in the previous discharge. The quantity of air induced into the tank can be varied directly by the size of the opening of the air induction valve and the spring pressure. Thus, any desired quantity of air can be induced into the tank and the amount of air induced is relative to the vacuum created by the flow of water in the passage 75, 76 which serves as a venturi tube by reason of the change in diameter at the valve inlet.

As the tank is initially discharged, the rush of water and air from the chamber in cylinder 106 above valve 128 creates a reduced pressure condition which holds the valve 128 open until such time as the water level in the main tank drops to a point to allow air from the main tank to pass around the valve 128 to equalize the pressure so that the valve 128 is allowed to drop further.

As the flow of water fills the tank, the air contained therein will rise and be compressed against the top of the tank. As pressure increases, it will move into the interior of the sleeve 106 and force the valve 120 down so that seat 130 is in contact with O-ring 162. This condition is shown in FIGS. 2 and 3 wherein it will be seen that valve flange 122 on flush valve 120 is not seated in the conical seat 108. When the pressure has reached a sufficient predetermined condition, the valve 120 will be forced down to a fully seated position pulling valve 160 with it and compressing the spring 146 so that flange 122 seals in the seat 108 and the O-ring 162, of course, remains sealed in the seat 130. At this point, water may still be flowing past the refill valve 184 through the opening 186 so that sufficient water will reach the flushing vessel to fill the trap. The final pressurizing of the tank will cause a closing of the valve 184 so that the parts are then again all sealed, ready for the next operation.

When the unit is flushed, the main valve will not close unless and until the air inducer allows the water level in the main tank to drop to a point which allows air to go up into the valve's upper chamber and break the vacuum that holds the main flush valve up. With the injection of air into this area, the valve then drops (by gravity) and chokes off (mostly) the discharge hole. With flow rate into tank higher than the open area of the partially choked off discharge hole, flow then goes up around the flush valve and pushes the valve 120 the rest of the way home. In other words, the chamber above the valve is expanded to close the valve. This is an important feature since it will be seen that should pressure in the tank decrease by reason of a loss of water pressure or a negative pressure in the supply, then backflow will be prevented since the spring 146 will open the valve 120 and allow water in the tank to dribble out, thus breaking any possible back siphoning action.

It will be appreciated that the dimensions in sizing relationships of the various elements allow water consumption to be regulated in a desired fashion. For example, the flush valve ring diameters, that is, the diameters of the flanges 124 and 126 may be varied relative to the inside diameter of the sleeve 106 to affect the open time of the valve. The height of the discharge adapter 98 from the bottom of the tank will control the total discharge volume and the cubic feet per minute rate of the air inducer will affect the total consumption by delaying or increasing the speed of the flush valve closure.

There are also built into the system various backflow prevention devices. In addition to the standard backflow control unit 48 which consists of two check valves in series with intermediate air induction zone, it will be noted that the main flush valve is held off the seal surface of the discharge adapter when water pressure is absent. The internal flow tube 66 causes compressed air to be pulled off into the supply line as a vacuum occurs rather than the inlet being exposed to water in the tank. This removes pressure which allows both the return spring and the refill spring to expand, thus opening the main flush valve and refill valve. When these, that is, either one of them is opened, the head pressure of the water in the tank will cause the tank water to drain into the bowl and not to be pulled into the supply line because of the vacuum therein.

The principal features of the backflow prevention are:

1. Flush valve 128: Spring loaded and held closed by pressure in the tank—above 2 psi.
2. Refill valve 184: Spring loaded and held closed by pressure in the tank—above 16 psi.
3. Supply tube 66: Connecting the outer inlet of the tank body to the highest point 67 inside the tank.
4. Anti-siphon device 48: Consisting of two back checks and intermediate air ports.
5. Air inducer valve 72: Normally used to pull outside air into the tank during refill but equally operational when flow is reversed.

Fresh water is injected into the tank through tube outlet 67 at least 1" above the highest point water can reach. When the tank charges to its maximum operating pressure, for example, of 85 psi, the air pocket on top of the tank has been compessed so that the inlet flow tube is slightly more than one inch above the water level. With the tank in this condition, should both back checks 48 fail and a vacuum occur on the supply system, air in the top of the tank will be pulled off into the supply system. Naturally, any water in the supply tube (supply side of the air gap) precedes the air.

As the air is pulled off the top of the tank, the pressure is reduced until the refill valve 184 is opened by a spring at, for example, 16 psi and the main flush valve 128 is opened at approximately 2 psi. With either or both of these valves open, the tank water begins to seep into the bowl because it is located above the bowl.

The anti-siphon device 48 consists of a double check design with intermediate air ports. Also, the air inducer 72 will draw air with flow in either direction. Thus, with a vacuum on the supply system and the extreme condition of both checks 48 fouled open, air is introduced into the supply line by the air ports in the anti-siphon device 48 and the air inducer 72.

The combination of the tank's air gap, elimination of pressure which causes the flush valve and refill valves to open, plus the outside air introduction features of the anti-siphon device and air inducer all combine to prohibit, under the worst conditions, back siphonage of contaminated fluid from the tank into the supply line.

I claim:

1. In a pressure flush tank system in which a water tank has a water inlet, a water outlet, a control cylinder vertically oriented above the water outlet, a main valve seat in the water outlet, a main flush valve in the cylinder adapted to seat on said main valve seat and having a central valve bore and a manual control valve operable in said central valve bore to open said control valve bore and thereby relieve pressure in the cylinder above the main flush valve, said main valve being movable in said cylinder in a slidable piston relationship and subject to pressure of said tank whereby opening the central bore will cause upward movement of said main valve in said cylinder and opening of said main valve seat, that improvement which comprises:

(a) an air inducer valve comprising an air vent opening in the water inlet of the water tank open to the top portion of the tank, an outwardly biased valve located in said water inlet movable to close said air vent opening and having a portion exposed to said water inlet, said valve being movable in response to reduced pressure induced by flow into said water tank through said water inlet and by negative pressure in said water inlet to admit air through said air vent opening to said tank.

2. In a pressure flush tank system in which a water tank has a water inlet, a water outlet, a control cylinder vertically oriented above the water outlet, a main valve seat in the water outlet, a main flush valve in the cylinder adapted to seat on said main valve seat and having a central valve bore and a manual control valve operable in said central valve bore to open said control valve bore and thereby relieve pressure in the cylinder above the main flush valve, said main valve being movable in said cylinder in a slidable piston relationship and subject to pressure of said tank whereby opening the central bore will cause upward movement of said main valve in said cylinder and opening of said main valve seat, that improvement which comprises:

(a) an extension to reduce flow noise on said control valve projecting into said outlet to restrict initial outflow from said tank when said control valve is moved to open said main valve.

3. A pressure flush tank system as defined in claim 2 in which said outlet includes a tapered flow passage and said extension includes a plate lying in a plane normal to the axis of said passage disposed to move into said flow passage having leading fins reduced in radial dimension from said plate to enter the outlet of said flow passage.

4. In a pressure flush tank system in which a water tank has a water inlet, a water outlet, a control cylinder vertically oriented above the water outlet, a main valve seat in the water outlet, a main flush valve in the cylinder adapted to seat on said main valve seat and having a central valve bore, and a manual control valve operable in said central valve bore to open said control valve bore and thereby relieve pressure in the cylinder above the main flush valve, said main valve being movable in said cylinder in a slidable piston relationship and subject to pressure of said tank whereby opening the central bore will cause upward movement of said main valve in said cylinder and opening of said main valve seat, that improvement which comprises:

(a) means resiliently biasing said main flush valve to a partially open position wherein pressure in said cylinder will cause full closing of said main valve, and loss of water inlet pressure in said tank will effect opening of said main valve to allow water to drain from said tank through said main valve seat thus removing it from the water inlet to prevent backflow in the event of below atmospheric pressure in said water inlet, and (b) a secondary valve opening communicating between the interior of said tank and said water outlet, a refill valve in said secondary valve opening to close the secondary opening in response to pressure in said tank, and means to bias said refill valve to an open position and responsive to a predetermined pressure in said tank to close the refill valve.

5. In a pressure flush tank system in which a water tank has a water inlet, a water outlet, a control cylinder vertically oriented above the water outlet, a main valve seat in the water outlet, a main flush valve in the cylinder adapted to seat on said main valve seat and having a central valve bore and a manual control valve operable in said central valve bore to open said control valve bore and thereby relieve pressure in the cylinder above the main flush valve, said main valve being movable in said cylinder in a slidable piston relationship and subject to pressure of said tank whereby opening the central bore will cause upward movement of said main valve in said cylinder and opening of said main valve seat, that improvement which comprises:

(a) a refill system including a resiliently biased, pressure responsive time-delay valve communicating between the interior of the tank and the outlet responsive to pressure in said tank to control the quantity of water entering the bowl after the siphonic flush action, (b) a flow restrictor valve in said water inlet to control the flow rate of water into said tank, and (c) said refill system comprising a secondary valve opening communicating between the interior of said tank and said water outlet, said time delay valve being located in said secondary opening to close the opening in response to predetermined pressure in said tank, and means to bias said time delay valve to an open position and responsive to a predetermined pressure in said tank to close the time-delay valve.

6. A pressure flush tank system as defined in claim 5 in which said flow restrictor valve comprises a valve automatically responsive to incoming line pressure having a resilient member movable to restrict said inlet upon increase in line pressure.

7. In a pressure flush tank system in which a water tank has a water inlet, a water outlet, a control cylinder vertically oriented above the water outlet, a main valve seat in the water outlet, a main flush valve in the cylinder adapted to seat on said main valve seat and having a central valve bore and a manual control valve operable in said central valve bore to open said control valve bore and thereby relieve pressure in the cylinder above the main flush valve, said main valve being movable in said cylinder in a slidable piston relationship and subject to pressure of said tank whereby opening the central bore will cause upward movement of said main valve in said cylinder and opening of said main valve seat, that improvement which comprises:

(a) a refill system communicating between the interior of the tank and the outlet responsive to pressure in said tank to control the quantity of water entering the bowl after the siphonic flush action, (b) a flow restrictor valve in said water inlet to control the flow rate of water into said tank, and (c) said refill system comprising means forming an opening in a wall of the main flush valve open to the interior of the tank, a refill valve in said opening to close the opening, and means carried by said valve to bias said refill valve to an open position responsive to a predetermined pressure in said tank to close the refill valve against said bias means.

8. In a pressure flush tank system in which a water tank has a water inlet, a water outlet, a control cylinder vertically oriented above the water outlet, a main valve seat in the water outlet, a main flush valve in the cylinder adapted to seat on said main valve seat and having a central valve bore, and a manual control valve operable in said central valve bore to open said central valve and thereby relieve pressure in the cylinder above the main flush valve, said main valve being movable in said cylinder in a slidable piston relationship and subject to pressure of said tank whereby opening the central bore will cause upward movement of said main valve in said cylinder and opening of said main valve seat, that improvement which comprises:

(a) means resiliently biasing said main flush valve to a partially open position wherein pressure in said cylinder will cause full closing of said main valve, and loss of water inlet pressure in said tank will effect opening of said main valve to allow water to drain from said tank through said main valve seat thus removing it from the water inlet to prevent backflow in the event of below atmospheric pressure in said water inlet, (b) a secondary valve opening communicating between the interior of said tank and said water outlet, a refill valve in said secondary valve opening to close the secondary opening in response to pressure in said tank, and means to bias said refill valve to an open position and responsive to a predetermined pressure in said tank to close the refill valve, (c) an inlet flow director tube in the tank connected to the water inlet and having an outlet adjacent the top of the tank above the water level wherein only air can backflow in the event of negative water pressure, and (d) an air vent in the water inlet of the water tank open to the top portion of the tank, a biased valve normally closing said air vent and movable against said bias to open said vent and having a portion exposed to said water inlet, said valve being movable in response to reduced pressure induced by flow into said water tank through said water inlet and by negative pressure in said water inlet to admit air through said air vent opening to said tank.

9. In a pressure flush tank system as defined in claim 8, a control stem on the manual control valve movable manually to a first position to open the bore in said main flush valve and movable by said resiliently biasing means to a second position to close the bore in said main flush valve, said stem being dimensioned to hold said main valve in an open position relative to said water outlet until pressure in said cylinder compresses said resilient biasing means.

* * * * *